US006049051A

United States Patent [19]

Dosmo et al.

[11] Patent Number: 6,049,051

[45] Date of Patent: Apr. 11, 2000

[54] LOW-VOLTAGE CIRCUIT BREAKER

[75] Inventors: Renato Dosmo, Brembate Di Sopra; Maurizio Curnis, Calusco D'Adda, both of Italy

[73] Assignee: ABB SACE S.p.A., Bergamo, Italy

[21] Appl. No.: 08/993,043

[22] Filed: Dec. 18, 1997

[30] Foreign Application Priority Data

Dec. 20, 1996 [IT] Italy ..... MI96A2689

[51] Int. Cl.[7] ..... H01H 33/02; H01H 33/08

[52] U.S. Cl. ..... 218/155; 335/202; 335/8

[58] Field of Search ..... 335/8–10, 202; 218/9, 14, 15, 26, 34, 44, 58, 87, 84, 152, 153, 154, 155, 156, 139–40, 134

[56] References Cited

U.S. PATENT DOCUMENTS

| | | | |
|---|---|---|---|
| 5,210,385 | 5/1993 | Morel et al. | 218/155 |
| 5,285,180 | 2/1994 | Rezac et al. | 335/202 |
| 5,298,874 | 3/1994 | Morel et al. | 335/8 |

*Primary Examiner*—Lincoln Donovan
*Attorney, Agent, or Firm*—Guido Modiano; Albert Josif

[57] ABSTRACT

Low-voltage circuit breaker exhibiting live levers operatively connected to a control device for opening and closing the circuit breaker, fixed live terminals and electric arc extinction chambers, there being provision for the levers, the terminals and an extinction chamber to be enclosed in half-shells constituting a pole, for the half-shells to be made from insulating material and for several poles to be clamped in a supporting frame.

24 Claims, 6 Drawing Sheets

LOW-VOLTAGE CIRCUIT BREAKER

BACKGROUND OF THE INVENTION

The invention relates to a low-voltage circuit breaker having poles containing levers for opening and closing the contacts, with terminals protruding from the circuit breaker and an electric arc extinction chamber.

It is known that in low-voltage circuit breakers, for example those for rated currents up to 6000 A, large electrodynamic and thermal stresses occur in the event of faults or short-circuits. The supporting structure of these circuit breakers must therefore be very robust and stiff and is usually made from metallic material. Moreover, it is known that electrical insulation devices are present in the circuit breaker in order to insulate the various phases or poles from one another and to insulate the live parts (or parts carrying current) from the metallic structure.

At the present time these electrical insulation devices consist of a complex series of protections or insulating barriers interposed between the live components (levers and terminals) and the supporting structure and between the live components of different phases. The supporting structures of the circuit breakers are made so as to receive several phases or poles and the control device for opening and closing the circuit breaker.

The dimensioning of the insulating protections has to take into consideration both the nominal working conditions and also the working conditions after many years of operation (with the circuit breaker soiled or fouled) and conditions which occur during a fault or short-circuit of the electrical line. However, the safety and electrical insulation characteristics provided for by the standards relating to personnel working near the circuit breaker and relating to the system in which the circuit breaker is connected must be guaranteed to be unimpaired for all conditions of operation of the circuit breaker.

The present-day make-up of circuit breakers demands very rigid phases of assembly. This poor flexibility in production is brought about essentially by the fact that in the structure of the circuit breaker there are insulating bases for supporting the live parts made as structural monoblocs which cannot be subdivided in the production process into preassembled subgroups or more generally into homogeneous families of components which permit flexibility and rationality in the production phases.

It is not therefore possible to customize the circuit breaker only in the final phases of the production chain, rather it is necessary to provide different production lines for each model of circuit breaker. This poor flexibility in production demands large investments in space for the assembly lines, heavy employment of resources and a consequent low level of productivity.

SUMMARY OF THE INVENTION

The objective of the invention is to reduce the drawbacks of the prior art, as listed earlier, and to simplify and rationalize the various constituent parts of the low-voltage circuit breaker and consequently of the production process.

A second objective of the invention consists in increasing the constructional modularity of the low-voltage circuit breaker.

A further objective of the invention is to improve the level of electrical insulation of the components carrying electric current while preserving high structural robustness of the circuit breaker.

The objectives of the invention are achieved by virtue of a low-voltage circuit breaker having poles containing levers for opening and closing contacts, with terminals protruding from the circuit breaker and an electric arc extinction chamber, characterized in that the levers, the terminals and the extinction chamber are enclosed in half-shells of containment which fit together, in that the half-shells consist of insulating material, in that the rear wall of the half-shells, which form a pole, exhibits openings surrounding the protruding part of the terminals, in that the front wall of the half-shells exhibits an opening for the passage of means of connection of the levers to a device for controlling the circuit breaker and in that several poles are housed in a supporting and stiffening frame.

In order to hold the poles correctly abreast and aligned, even in the event that high electrodynamic and thermal stresses occur during the operation of the circuit breaker, the poles are pressure-assembled with the supporting frame.

In order to enclose the poles in a robust and stiff structure, the supporting frame of the circuit breaker is composed of flanks connected together by transverse bars and reinforcing cross-members.

In order to align the poles with respect to the supporting frame the half-shells exhibit through holes which receive transverse bars secured to the flanks.

In order to isolate the parts of the supporting frame from the poles, the transverse bars, inserted through the half-shells, are coupled externally with insulating tubes of equal length to the bars.

In order to house the levers and various sensors inside the pole, consisting of the assembled half-shells, there are hollows.

Advantageously, one hollow receives the levers and is in connection with an upper hollow which receives the electric arc extinction chamber.

With further advantage the hollow exhibits in the front wall of the pole an opening for the connection of the movable components to the device for controlling the circuit breaker, by means of an insulating link-rod.

To facilitate the removal of the extinction chamber with the circuit breaker assembled and to allow easy access to the live components, the extinction chamber exhibits a plane for bearing on the half-shells which is fashioned as an inclined plane.

In order to support the terminals in an accurate position, there are seats in the rear part of the body of the half-shells.

The upper terminal, in order to be locked in an accurate position with respect to the half-shells, exhibits a projection geometrically coupled with a groove present in the body of the half-shells and which delimits the seat thereof.

In order to avoid displacements in the event of high electromagnetic forces, the upper terminal is coupled by a screw means to the body of the half-shells.

To prevent the head of the threaded means from locally damaging the half-shells of insulating material, between the head of the screw means and the half-shells there is a washer.

To facilitate the assembly and disassembly of the pole, the head of the screw means is placed on an access indentation present in the rear wall of the pole.

To lock the lower terminal with great accuracy with respect to the pole, at least one connecting and reinforcing bracket is provided between the body of the half-shells and the terminal.

Advantageously, one end of the fixing bracket of the terminal is dynamically coupled to a groove present in the body of the half-shells.

A further advantage for easy removal is the fact that a fixing bracket of the terminal is connected to the half-shells by screw means, and that the screw means are engaged in an insert having threaded holes, which is housed in a T seat in the body of the half-shells.

In order to house a current transformer in a protected manner in the body of the pole, a rear hollow is provided around the lower terminal receiving the transformer when fitted onto the terminal.

In order to lead electrical connection cables of the current transformer out from the pole in a protected manner, the body of the half-shells exhibits an opening in the lateral walls of the rear hollow.

In order to carry the electrical connection cables of the transformer from the rear wall of the pole to the front wall, the half-shells exhibit on their outside a groove extending from the opening of the rear hollow to the front side of the half-shells.

In order to isolate the current transformer, the rear hollow is closed by a panel.

Advantageously the panel exhibits openings for the passage of the terminals of the circuit breaker.

In order to make the data relating to the characteristics of the current transformer visible externally, when the circuit breaker is assembled, the panel exhibits an opening in the vicinity of a data plate of the transformer.

To improve the isolation of the live components, the front wall of one half-shell exhibits on the inside and longitudinally a groove and the corresponding wall of the second half-shell exhibits a projection which can be coupled with the groove.

In order to connect the poles to the supporting and reinforcing frame, the half-shells exhibit seats receiving mounting inserts exhibiting threaded holes for connecting the fixing means.

The advantages of the invention are to be seen mainly in the more rational and simplified construction of the low-voltage circuit breaker and in the consequent simplification of its production process.

A further advantage consists in the modular structure of each individual pole.

This modularity makes it possible to preassemble the pole on its own using the half-shells as support for the levers, for the terminals and for the electric arc extinction chamber. With the circuit breaker under operational conditions, by virtue of the assembled half-shells, the live components of a pole are insulated and isolated from the other poles and from the various parts of the clamping and supporting frame.

An advantage is the possibility of making the circuit breaker itself in a modular manner, provided with several poles. The modularity of the circuit breaker is obtained by using groups of elementary poles which are all identical and metal stiffening supports of variable length.

Advantageously the modularity of construction of the poles and of the circuit breaker makes it possible to use a smaller number of production lines and in particular lines of a highly automated type, in which the circuit breaker is customized only in the final phases of production.

A further advantage is that the circuit breaker is of high structural stiffness. Structural stiffness ensured by the frame formed by the joining together of the flanks, in the cross-members and the control set.

BRIEF DESCRIPTION OF THE DRAWINGS

The subject, devised according to the present invention, will be described below in more detail and illustrated by means of an embodiment, given merely by way of example, in the appended drawings in which.

DESCRIPTION OF THE PREFERRED EMBODIMENTS

The low-voltage circuit breaker is of known operation and make up, so that in what follows only the parts which are novel and essential for the invention will be described.

Figure 1:
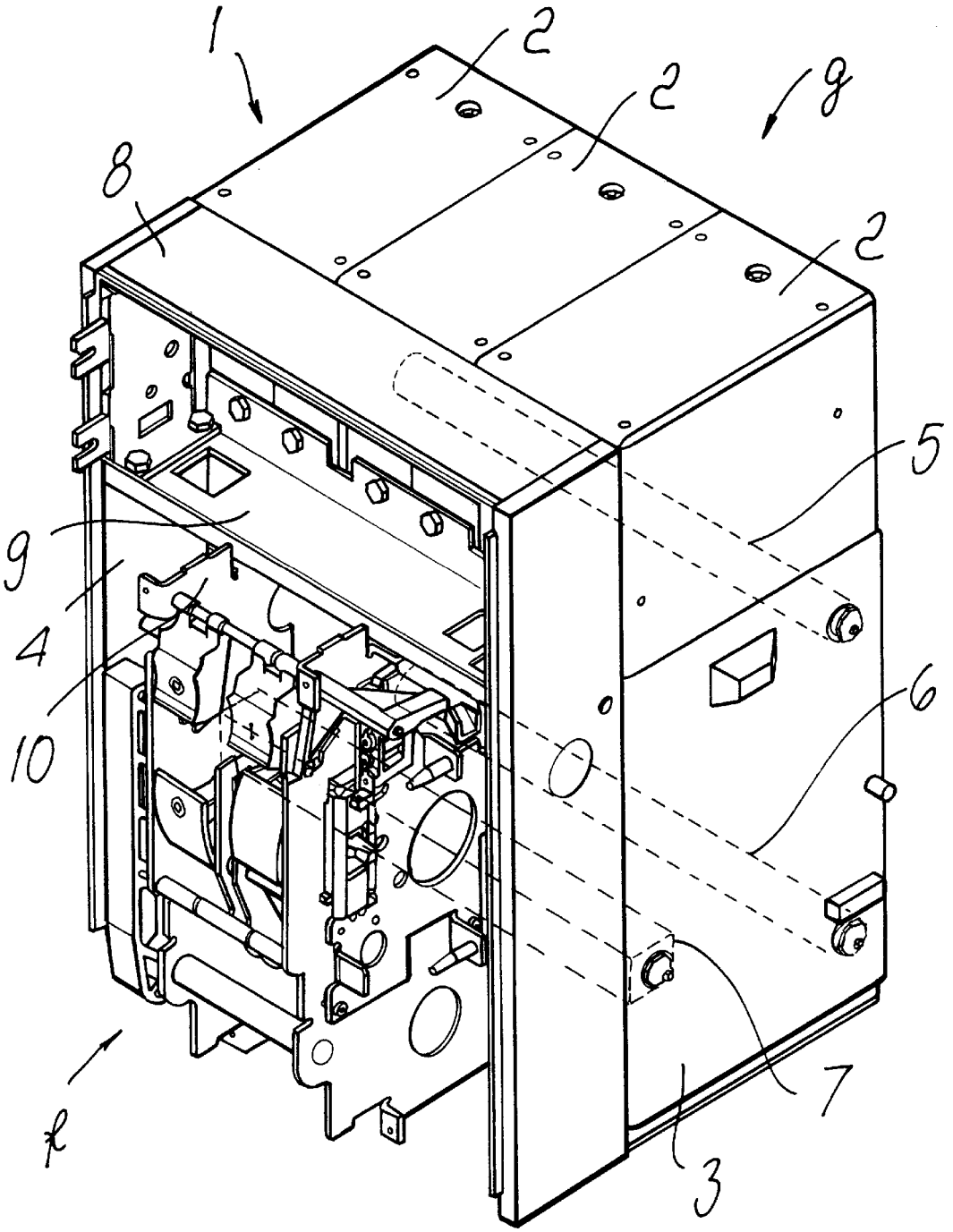
FIG. 1 illustrates, in an axonometric view, a low-voltage circuit breaker devoid of its front hatch.

The main constituent components of the low-voltage circuit breaker may be gleaned from FIG. 1. The circuit breaker is labelled 1 overall.

The circuit breaker 1 exhibits at the rear (in the direction of the arrow g) three poles 2 laterally abreast and clamped between two walls, forming abutments 3, 4 connected to transverse bars 5, 6, 7 and cross-members 8, 9.

At the front (in the direction of the arrow f) there is a known control device 10, operatively connected with the poles 2 and supported by the transverse bar 7 and by the cross-member 9.

Figure 2:
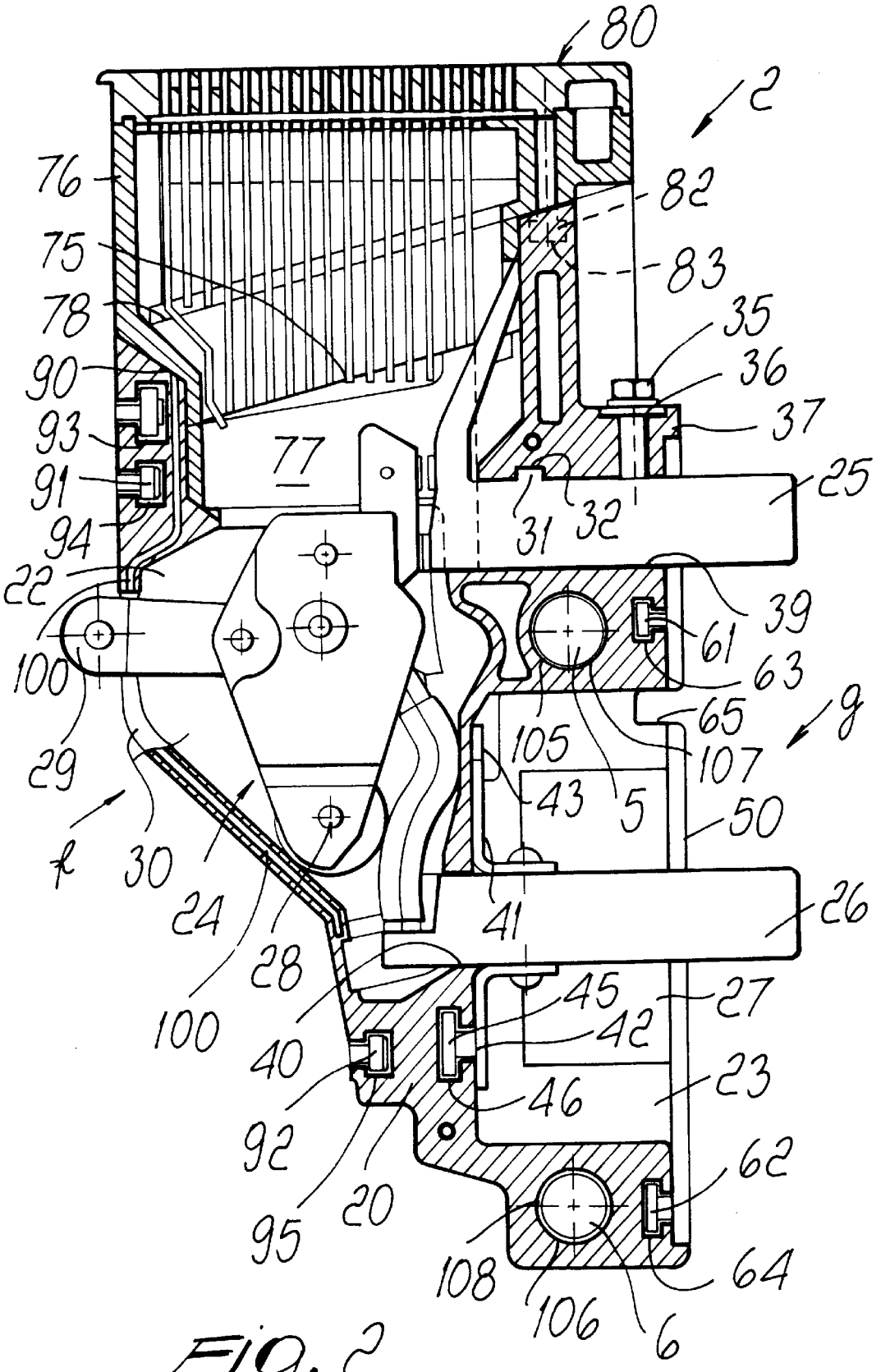
FIG. 2 shows, in lateral cross-section, a pole.
Figure 3:
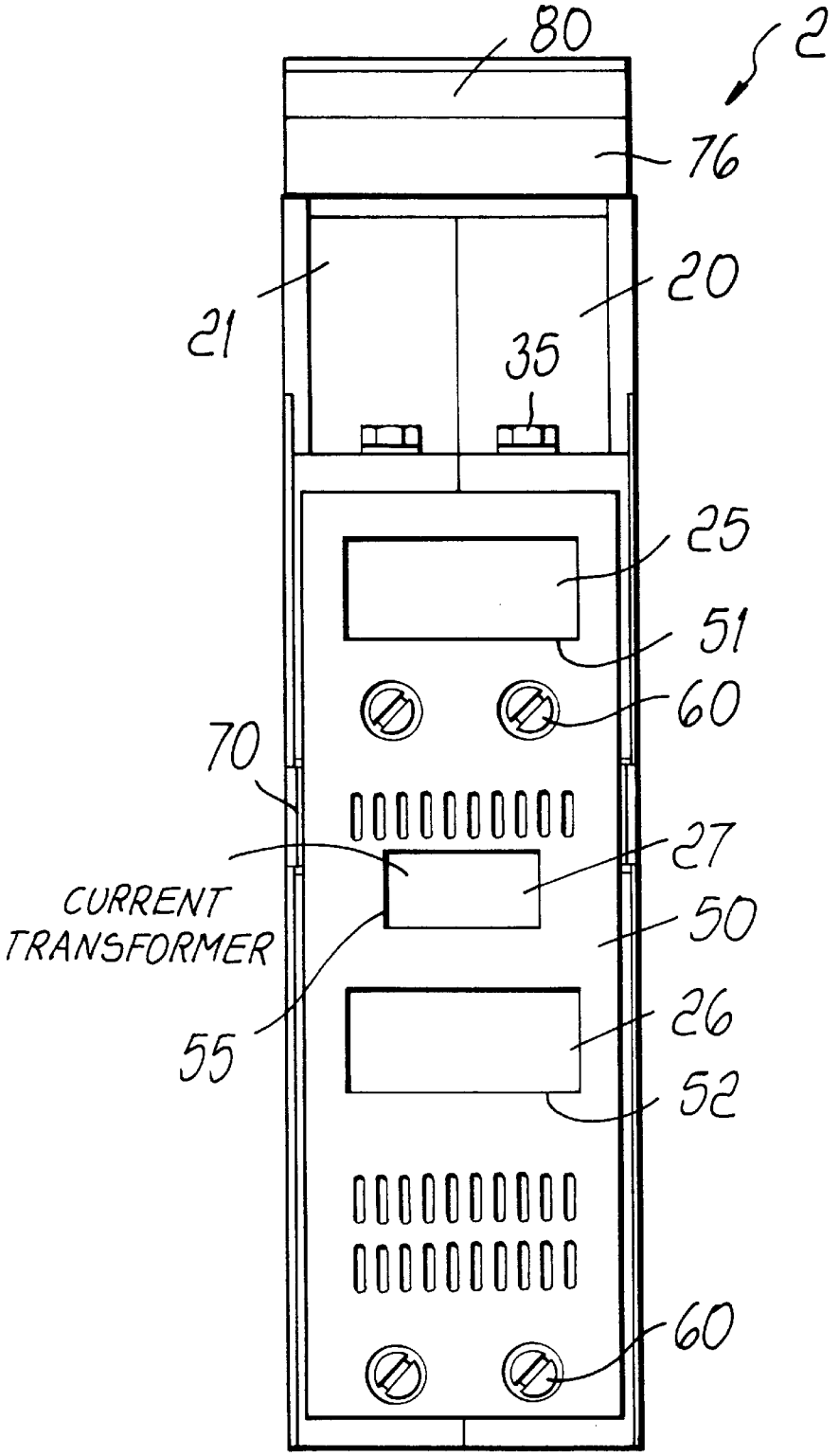
FIG. 3 shows the rear view of the pole of FIG. 2.
Figure 4:
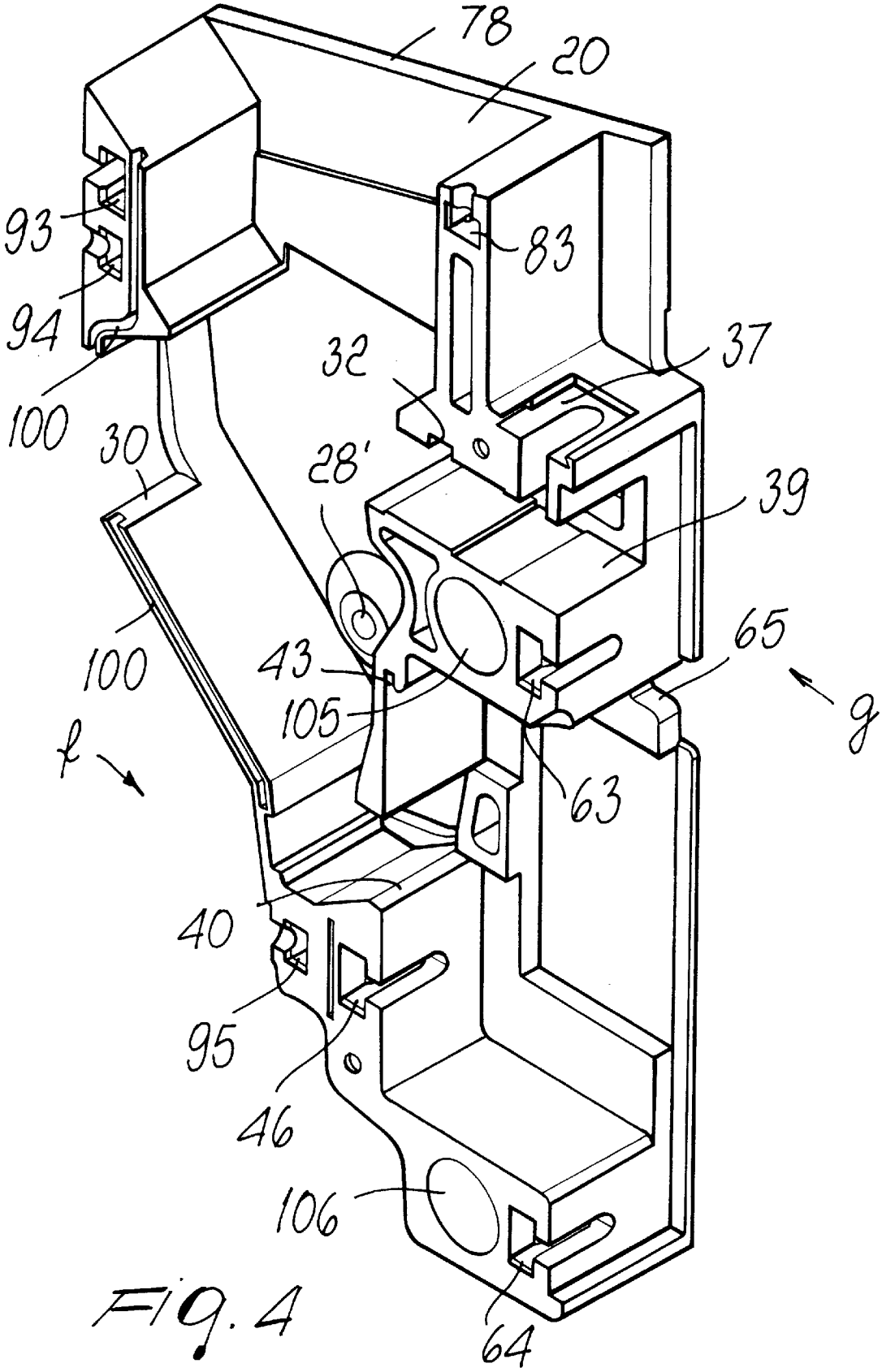
FIG. 4 illustrates, in an axonometric view, a half-shell for supporting and insulating a pole.

From FIGS. 2, 3 and 4 it is possible to see the construction of one of the poles 2 of the circuit breaker 1.

The pole 2 consists of known live levers, labelled 24 overall, and terminals enclosed in laterally adjacent half-shells 20, 21 joined by geometrical coupling. The two adjacent half-shells 20, 21 exhibit two main hollows 22, 23 where the levers 24 and the terminals 25, 26 are received. The levers 24 are supported, by a seat 28' receiving a swivel pin 28, at the insulating half-shells 20, 21.

The levers 24 are in operational connection with the control device 10 (not illustrated) of the circuit breaker 1 by means of the insulating link-rod 29 protruding from an opening 30 present in the front wall (f) of the half-shells 20, 21.

The terminals 25, 26 are supported by the half-shells 20, 21. The upper terminal 25 is received in a seat 39 present in the upper and rear part of the half-shells 20, 21. This terminal 25 is connected to the half-shells 20, 21 via a projection 31 inserted into a groove 32 present in the seat 39 and via screws 35. The screws 35 fix the upper terminal 25 transversely to the half-shells 20, 21.

Advantageously, washers 36, housed in appropriate seats 37 present in the half-shell 20, 21, are interposed between the head of the screws 35 and the half-shells 20, 21.

The lower terminal 26 is received in a seat 40 present low down in the half-shells 20, 21. The lower terminal 26 is connected to the half-shells 20, 21 with brackets. The brackets 41, 42 are connected on one side to the terminal 26.

Advantageously the side transverse to the terminal 26 of the brackets 41, 42 is inserted into appropriate grooves 43 in the half-shells 20, 21. Alternatively the transverse sides of the brackets 41, 42 are fixed by threaded means to metal inserts 45 present in appropriate T wells 46 made in the half-shells 20, 21.

A sensor, for example a current transformer 27, is received by the lower terminal 26 and housed in the rear hollow 23 present in the half-shells 20, 21.

The hollow 23 is closed by a panel 50. The panel 50 has two openings 51, 52 into which are inserted the upper terminal 25 and the lower terminal 26 respectively.

The panel 50 has a further opening 55 provided in the vicinity of the rear lateral surface of the current transformer 27, to which the plate bearing the characteristics of the current transformer 27 is usually attached.

The panel 50 is fixed to the half-shells 20, 21 by screws 60. The screws 60 are connected to inserts 61, 62 housed in T wells 63, 64 present in the rear wall (g) of the half-shells 20, 21.

The lateral walls of the rear hollow 23 have an opening 65.

Advantageously electric cables, not illustrated, for connection to the current transformer 27 emerge from the opening 65 of the rear hollow 23.

With further advantage, on the outsides of the half-shells 20, 21 there are transverse grooves 70 traversing the entire body of the half-shells 20, 21 (FIG. 5) housing the electric cables (not illustrated) of the current transformer 27.

The hollow 22 housing the levers 24 is in connection with an upper hollow which receives an electric arc extinction chamber 75.

The extinction chamber 75 is essentially of known makeup. The walls 76 of the extinction chamber 75 exhibit low down a projection bearing on a stirrup 77. The stirrup 77 is inserted laterally to the live components and is connected with geometrical coupling to the hollow 22.

The body 76 of the electric arc extinction chamber 75 bears laterally along an inclined plane 78 on the upper part of the half-shells 20, 21.

The body 76 of the extinction chamber 75 is connected to the half-shells 20, 21 by threaded means 81 connected to an insert 82 inserted into a T groove 83 present in the upper part of the half-shells 20, 21.

At the top, the extinction chamber 75 is closed by a cover 80.

On the front side (in the direction of the arrow f) of the half-shells 20, 21 there are inserts 90, 91, 92 for connection by threaded means of the cross-members of the supporting structure.

The inserts exhibit threaded holes and are inserted into T grooves 93, 94, 95.

Along the front wall of a half-shell 20 there are grooves 100 shaped to constitute a seat for a projection 101 (FIG. 5) present on the opposite half-shell 21.

When the groove and the projection 101 are geometrically coupled they make a labyrinth which prevents the passage of the electric arc.

At the rear, in the central part and in the lower part, the half-shells 20, 21 exhibit two holes 105, 106 housing the transverse bars 5, 6 of the supporting frame, which are inserted into tubes 107, 108 of insulating material of equal length to the transverse bars 5, 6.

Figure 5:
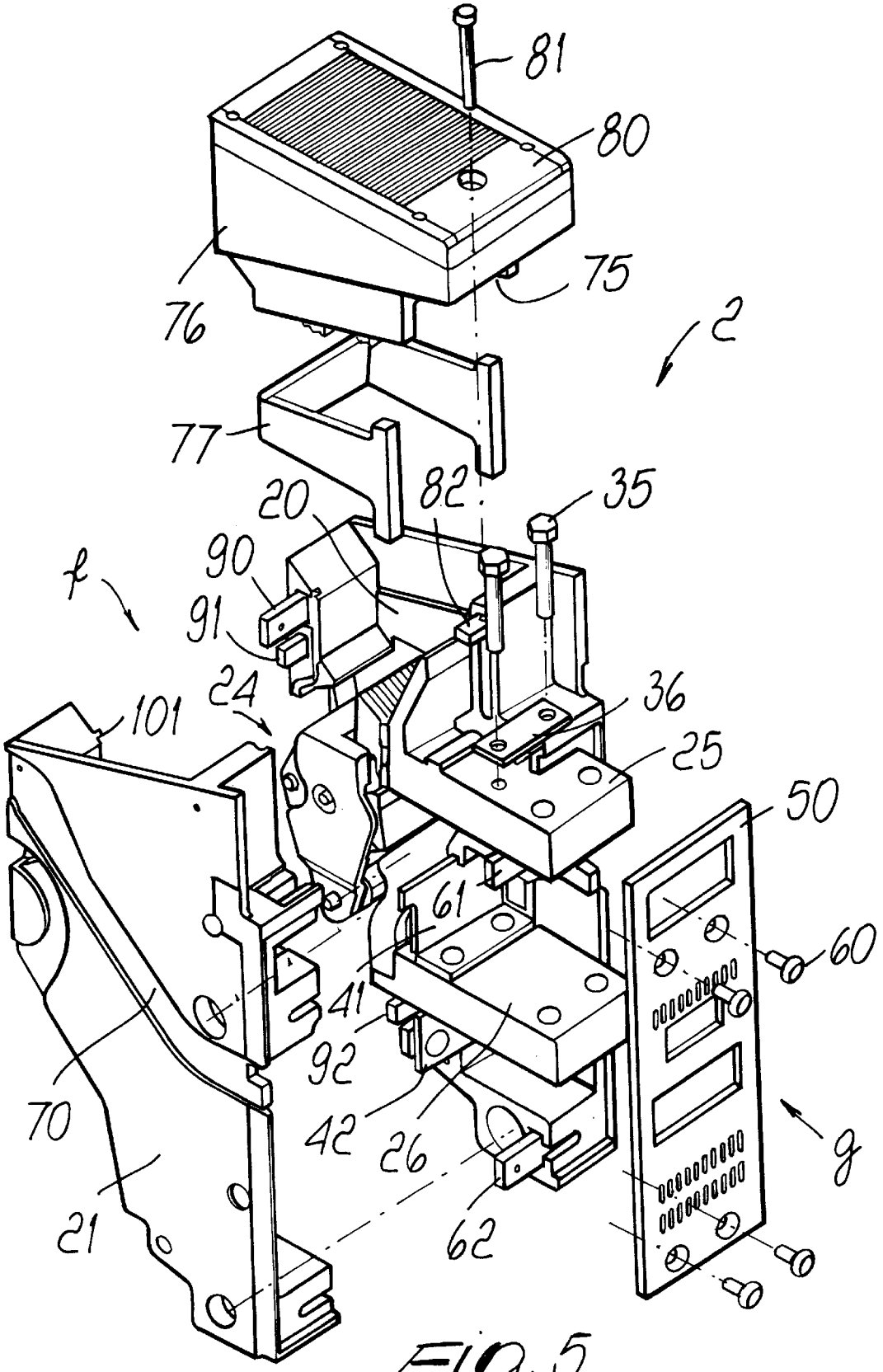
FIG. 5 shows, in an exploded axonometric view, the constituent parts of a pole.
Figure 6:
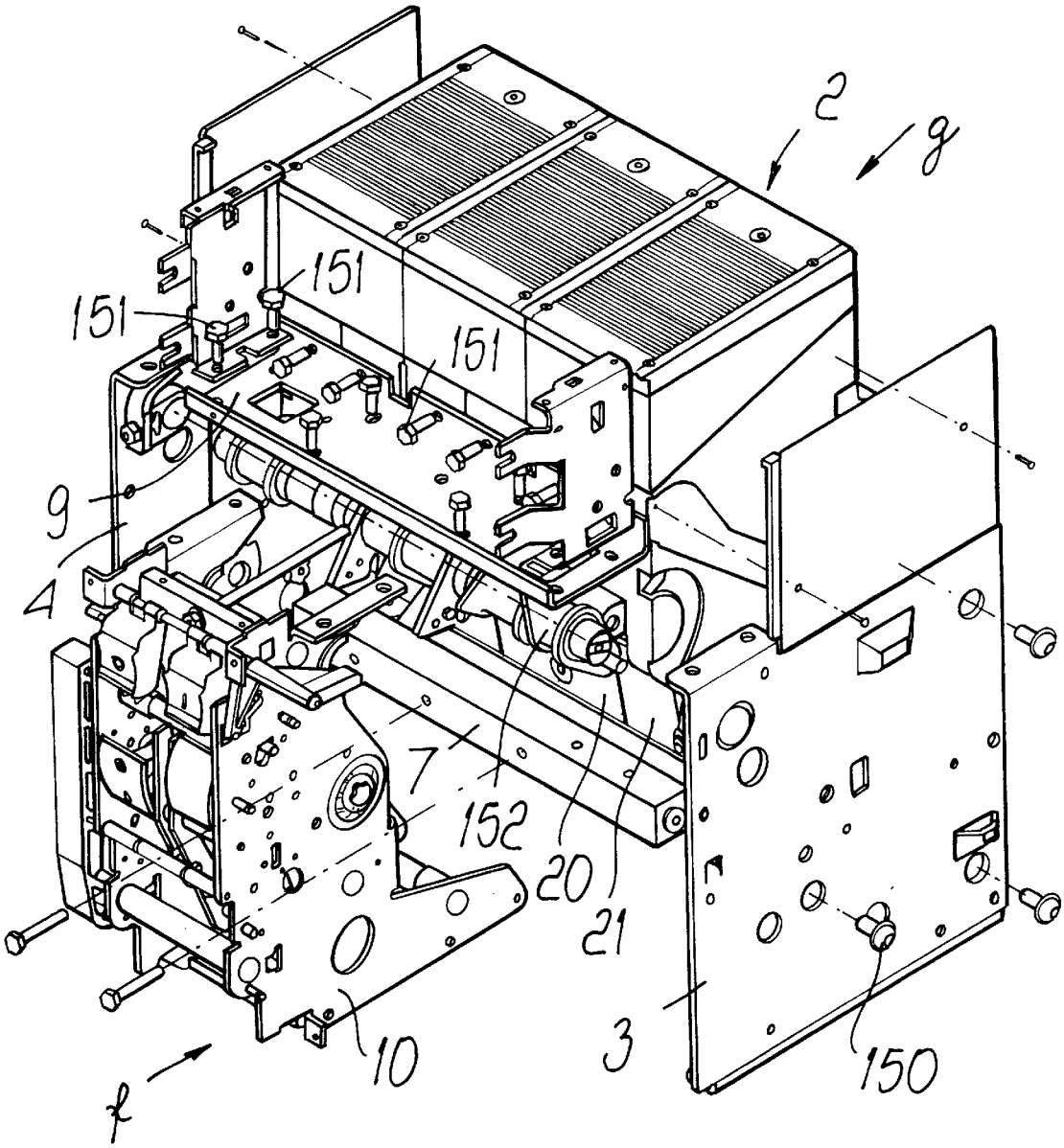
FIG. 6 illustrates, again in an exploded axonometric view, the main constituent parts of the low-voltage circuit breaker of FIG. 1.

FIGS. 5 and 6 will be employed to describe a possible method of assembling the pole 2 and then the circuit breaker 1.

Using an insulating half-shell 20 as supporting base, the upper terminal 25 is inserted, from the inside of the half-shell 20, into its seat 39.

In this way the projection 31 present on the terminal 25 is inserted into the groove 32 preventing any movement of the terminal 25 in the direction of its axis.

The terminal 25 is subsequently fixed to the half-shell 20 by means of the screw 35 engaged in an appropriate hole present on the terminal 25.

The screw 35 is tightened against the washer 36 previously inserted into its seat 37 so as not to cause local damage to the insulating material of the half-shell 20. The screw 35 is accessible from the rear even when the half-shells 20, 21 are coupled.

The movable live components 24 are connected to the half-shell 20 by inserting the swivel pin 28 into the seat 28' present in the lower part of the central hollow 22.

Simultaneously the lower terminal 26, connected to the movable live components 24, is inserted into the seat 40.

The brackets 41, 42 have previously been connected to the terminal 26. Upon inserting the terminal 26 laterally into the seat 40 the upper bracket 41 is coupled dynamically to the groove 43 and the lower bracket 42 is fixed by means of a screw to the insert 45 previously inserted into the seat 46.

The screws 45 are accessible from the rear even when the half-shells are coupled.

The inserts 61, 62, 82 necessary for fixing with threaded means the rear plate 50 and the electric arc extinction chamber 75 are then inserted into the seats 63, 64, 83. The inserts 90, 91, 92 necessary for connecting the pole 2 (consisting of the two half-shells 20, 21) to the supporting frame are also housed in the seats 93, 94, 95.

The inserts 61, 62, 83, 90, 91, 92, the shaped groove 100, the terminals 25, 26 mounted on one half-shell 20 and the swivel pin 28 for the movable live components 24 make guides for the second half-shell 21 which is geometrically coupled to the first half-shell 20.

Having fixed the terminals 25, 26 to the second half-shell 21 (in a similar manner to that carried out on the first half-shell 20), it is possible to insert the stirrup 77 and the extinction chamber 75 into the upper opening of the central hollow 22. The chamber 75 is fixed to the half-shells 20, 21 by a screw 81.

It is then possible to close the chamber 75 at the top with the cover 80, fixing it with threaded means to the body 76 of the chamber 75.

After having fitted the current transformer 27 onto the terminal 26, the transformer 27 is housed in the rear hollow 23.

It is then possible to close the hollow 23 with the panel 50, connecting it to the half-shells 20, 21 with screws 60.

Having placed abreast and aligned several poles 2, for example three for a three-pole circuit breaker as illustrated, the transverse bars 5, 6 (not illustrated) are inserted into the through holes 105, 106. The bars 5, 6 have previously been housed in insulating tubes 107, 108 of equal length.

After having connected the transverse bar 7 and the cross-member 9 to the front wall of the poles 2, the poles 2 are clamped between the flanks 3, 4. The flanks 3, 4 are then connected to the bars 5, 6, 7 and the cross-member 9 with the screws 150, 151, so constituting the supporting frame of the circuit breaker 1.

The operating shaft 152 is then connected to the insulating link-rods 29 of the various poles 2 and to the supports present on the flanks 3, 4.

The operating shaft 152 is connected to the control device 10. The control device 10 for opening and closing the circuit breaker 1 is connected by threaded means to the transverse bar 7 and to the cross-member 9.

The circuit breaker is then completed by connecting the cross-member 8 at the top, flank-cover panels laterally and a hatch at the front (these are not illustrated).

The coupling of the electric arc extinction chamber 75 with the half-shells 20, 21 on an inclined plane 78 makes it possible to dismantle the extinction chamber 75 even when the circuit breaker 1 is assembled.

After having unscrewed the connecting screw 81 it is possible to rotate the extinction chamber 75 along the rear side.

Removal of the chamber 75 allows access to the levers 24 without dismantling the pole 2.

What is claimed is:

1. A low-voltage circuit breaker comprising:

electrical contacts;

poles containing levers for opening and closing said contacts, with terminals protruding from the circuit breaker; and an electric arc extinction chamber;

wherein the levers, the terminals and the extinction chamber are enclosed in half-shells of containment which fit together, said half-shells being made of insulating material; wherein the rear wall of the half-shells, which form a pole, presents openings surrounding a protruding part of the terminals; wherein the front wall of the half-shells is provided with an opening for the passage of means of connection of the levers to a device for controlling the circuit breaker and wherein several poles are housed in a supporting and stiffening frame, said frame being composed of flanks connected together by transverse bars and reinforcing cross-members.

2. The circuit breaker according to claim 1, wherein the poles are pressure-assembled with the supporting frame.

3. The circuit breaker according to claim 1, wherein the extinction chamber is provided with an inclined plane for bearing on the half-shells.

4. The circuit breaker according to claim 1, wherein said half-shells present through holes which receive said transverse bars secured to the flanks.

5. The circuit breaker according to claim 1, wherein the transverse bars are coupled externally with insulating tubes of equal length to the bars.

6. Circuit breaker according to claim 1, wherein hollows are defined inside the pole, consisting of the assembled half-shells.

7. Circuit breaker according to claim 6, wherein one hollow receives the levers and is in connection with an upper hollow which receives the electric arc extinction chamber.

8. The circuit breaker according to claim 7, wherein an opening is defined in the front wall of the pole, for the connection of the levers to the device for controlling the circuit breaker, by means of an insulating link-rod.

9. The circuit breaker according to claim 1, wherein in the rear part of the body of the half-shells seats are provided to receive the terminals.

10. The circuit breaker according to claim 9, wherein the upper terminal exhibits a projection geometrically coupled with a groove defined in the body of the half-shells.

11. The circuit breaker according to claim 9, wherein the upper terminal is coupled by a screw means to the body of the half-shells.

12. The circuit breaker according to claim 11, wherein between the head of the screw means and the half-shells a washer is provided.

13. The circuit breaker according to claim 12, wherein the heads of the screw means are placed on an access indentation present in the rear wall of the pole.

14. The circuit breaker according to claim 11, wherein at least one connecting and reinforcing bracket is provided between the body of the half-shells and the lower terminal.

15. The circuit breaker according to claim 14, wherein one end of the connecting bracket of the terminal is dynamically coupled to a groove present in the body of the half-shells.

16. The circuit breaker according to claim 14, wherein a connecting bracket of the terminal is connected to the half-shells by screw means, and wherein the screw means are engaged in an insert with threaded holes which is housed in a T seat in the body of the half-shells.

17. The circuit breaker according to claim 1, wherein a rear hollow receiving a current transformer fitted onto the terminal is provided in the body of the pole around the lower terminal.

18. The circuit breaker according to claim 17, wherein the body of the half-shells exhibits an opening in the lateral wall of the rear hollow.

19. The circuit breaker according to claim 18, wherein the half-shells exhibit on their outside a groove extending from the opening of the rear hollow to the front side of the half-shells.

20. The circuit breaker according to claim 17, wherein the rear hollow is closed by a panel.

21. The circuit breaker according to claim 20, wherein the panel is provided with openings for the passage of the terminals of the circuit breaker.

22. The circuit breaker according to claim 20, wherein the panel is provided with an opening in the vicinity of a data plate of said transformer.

23. The circuit breaker according to claim 1, wherein the front wall of one half-shell exhibits on the inside and longitudinally a groove and the corresponding wall of the second half-shell exhibits a projection which can be coupled with the groove.

24. The circuit breaker according to claim 1, wherein the half-shells are provided with seats receiving mounting inserts exhibiting threaded holes for connecting fixing means.

* * * * *